United States Patent [19]

Sakurai

[11] Patent Number: 4,835,938

[45] Date of Patent: Jun. 6, 1989

[54] METHOD AND APPARATUS FOR DELIVERING AND WINDING PACKING PAPER

[75] Inventor: Tomonari Sakurai, Saitama, Japan

[73] Assignee: Laurel Bank Machines Co., Ltd., Tokyo, Japan

[21] Appl. No.: 118,053

[22] Filed: Nov. 9, 1987

Related U.S. Application Data

[62] Division of Ser. No. 15,988, Feb. 18, 1987, Pat. No. 4,729,211.

[30] Foreign Application Priority Data

Feb. 28, 1986 [JP] Japan ..... 61-43456

[51] Int. Cl.[4] ..... B65B 11/04

[52] U.S. Cl. ..... 53/212; 53/389

[58] Field of Search ..... 53/212, 389, 465, 211, 53/587; 225/100, 106

[56] References Cited

U.S. PATENT DOCUMENTS

| | | | |
|---|---|---|---|
| 3,821,917 | 7/1974 | Hatanaka | 83/272 |
| 4,219,985 | 9/1980 | Uchida et al. | 53/212 |
| 4,284,221 | 8/1981 | Nagel | 225/100 |
| 4,554,775 | 11/1985 | Asami | 53/212 X |
| 4,628,667 | 12/1986 | Humphrey | 53/587 X |

FOREIGN PATENT DOCUMENTS

| | | |
|---|---|---|
| 47-25512 | 7/1972 | Japan . |
| 54-31382 | 3/1979 | Japan . |
| 56-48927 | 5/1981 | Japan . |
| 1177669 | 1/1970 | United Kingdom . |

*Primary Examiner*—John Sipos

*Attorney, Agent, or Firm*—Fleit, Jacobson, Cohn & Price

[57] ABSTRACT

A rod-like stack of coins is introduced between packing rollers. A packing paper is fed between the stack of coins and the packing rollers at a low speed which is the same speed as the rotation of the packing rollers; and the stack of coins is then partially packed at the low speed. Thereafter the stack of coins is packed at a higher speed.

4 Claims, 5 Drawing Sheets

METHOD AND APPARATUS FOR DELIVERING AND WINDING PACKING PAPER

This is a divisional of Application Ser. No. 15,988, filed Feb. 18,1987 now U.S. Pat. No. 4,729,211.

BACKGROUND OF THE INVENTION

The present invention relates to a packing machine for packing a plurality of stacked coins and particularly to a method and apparatus for delivering and winding a sheet of packing or package paper about the stacked coins.

Coin packing systems are known, for example, by Japanese Patent Publication 47-25512, Japanese Laid-Open Patent Application 56-48927 and other publications.

In these coin packing systems, a sheet of packing paper is fed between a stack of coins and one of three packing or package rollers to wind the packing paper about the coin stack. Therafter, the opposite ends of the wound packing paper are crimped to form a package of the stacked coins.

The coin packing apparatus disclosed in said Patent Publication 47-25512 has a reduced life acting on the packing paper to stabilize it in its path of movement since the velocity of the delivered paper is low. On the other hand, however, the packing rollers are rotated at a higher speed to crimp the wound paper at its opposite ends. This results in a difference of velocity between the coin stack and the one packing roller. When the packing paper is moved in between the coin stack and that packing roller, therefore, the packing paper is subjected to an abrupt tension which can cause failure of packing such as coiling or the like.

The coin packing apparatus disclosed in said Laid-Open Patent Application 56-48927 is intened to increase the packing velocity of stacked coins and also to relieve the shock created when the packing paper begins to be wound around the coin stack by causing the velocity of the delivered packing paper to be equal to the rotational velocity of the packing roller and by increasing the velocities of both the packing paper and roller. However, an increased lift will act on the packing paper being moved at an increased velocity. As a result, the leading edge of the moving paper may turn up, changing the direction of movement so that it will be difficult to feed the packing paper into a predetermined position.

Although it may be conceived that both the velocities of the delivered paper and rotated packing roller are reduced, this may result in insufficient crimping and also in prolonging the time required to pack a coin stack.

SUMMARY OF THE INVENTION

In view of the above problems, it is an object of the present invention to provide a coin packing apparatus which can stabilize a sheet of packing paper in motion along its path of movement, which can relieve any shock created when the packing paper is moved in between a coin stack and a packing roller and which can increase the packing velocity of the coin stack.

To this end, the present invention provides an apparatus comprising a drive mechanism for rotatably driving said packing and feed rollers and a control circuit for detecting the movement of said feed rollers which unwinds the lenght of the packing paper to be wound about the coin stack, said mechanism being responsive to the absence of a detection signal from said control circuit to rotate said feed rollers and associated packing rollers at a low speed and responsive to a detection signal from said control circuit to stop said feed rollers and to rotate said packing rollers at a higher speed.

In accordance with the present invention, the packing paper is moved at a reduced velocity prior to the step of moving the leading edge of the packing paper in between the coin stack and the packing roller. Therefore, a reduced life will act on the packing paper being moved to prevent its leading edge from being turned up. Furthermore, the shock created when the packing paper is moved in between the coin stack and the packing roller can be alleviated since the velocity of movement in the packing paper is equal to the rotational velocity of the packing roller. Moreover, the packing paper is wound about the coin stack at an increased velocity after only a part of the packing paper has been wound about the coin stack. Consequently, a given length of the packing paper can be wound about the coin stack in a reduced period of time.

BRIEF DESCRIPTION OF THE DRAWINGS

The above and other objects of the invention will be seen by reference to the following description taken in connection with the accompanying drawings, in which.

DESCRIPTION OF THE PREFERRED EMBODIMENTS

The present invention will now be described in connection with embodiments of a paper feed device in a coin packing machine according to the present invention, with reference to the drawings.

Referring now to FIGS. 1 to 4, there is shown a first embodiment of said paper feed device comprising a rotating disc 1 on which a number of coins are placed. Adjacent to the outer periphery of the rotating disc 1, there is provided a guide 2 for guiding coins tangentially delivered from the disc 1 as the latter is being rotated. The guide 2 is connected with a coin passageway 3 adapted to guide the coins C into a line. Above the coin passageway 3, there is operatively located a conveyor belt 4 for moving the coins along the coin passageway 3. The coin passageway 3 includes an optical or magnetic sensor (not shown) for sensing and counting the passage of each coin and a stop (not shown) for blocking the flow of coins in the passageway 3 if required.

Figure 2:
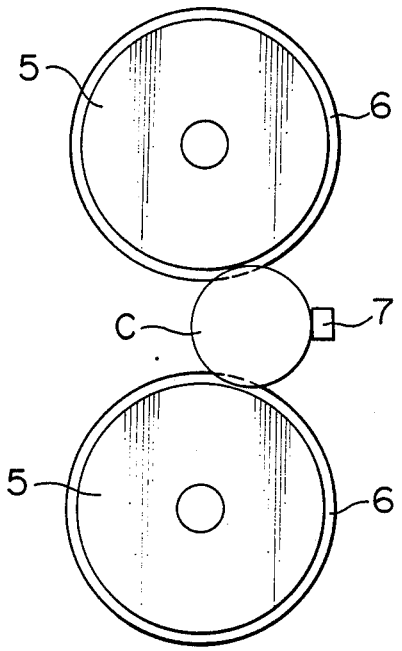

Ahead of the coin passageway 3 is provided a pair of stacking drums 5 for downwardly guiding the coins delivered from the coin passageway 3 while stacking them one above another. The stacking drums 5 are arranged parallel to each other and spaced at their outer peripheries away from each other by a distance slightly smaller than the external diameter of the coin. Each of the stacking drums 5 includes a spiral ridge 6 formed thereon at the outer periphery, the spiral ridges 6 on the drums 5 being opposite to each other in orientation. When the stacking drums 5 are rotated in the opposite direction but at the same speed, each coin is supported at its peripheral edge by the ridges 6 on the stacking drums 5 and also by a guide member 7 extending parallel to the stacking drums 5 as shown in FIG. 2. In such a situation, the coins are moved downwardly to form a skewed rod-like stack.

A shutter (not shown) is provied below a space (hereinafter called "stacking area") which is enclosed by the stacking drums 5 and the guide member 7. Thus, after a predetermined number of coins has horizontally been stacked on the shutter, the shutter is horizontally moved out of its closed position to its opened position, so that the stack of the coins falls onto a lower support member (not shown). Thereafter, the coin stack will be moved between packing roller 8, 9 and 10 which are located just below the shutter.

Two of the packing rollers 8 and 9 are rotatably supported by the respective roller support arms 12 and 13 at their free ends. The roller support arms 12 and 13 are horizontally pivotally supported about a shaft 11. The other packing roller 10 is rotatably supported by another roller support arm 15 at its free end, which is pivotally mounted about a shaft 14 extending parallel to said shaft 11. The proximal end portions of the roller support arms 12 and 15 are pivotally connected with a link 17 by pins 16. When the proximal end of the roller support arm 12 is moved in the direction of narrow (a) shown in FIG. 1, the packing rollers 8 and 10 are moved toward each other. When the proximal end of the roller support arm 12 is moved in the opposite direction as shown by arrow (b) in FIG. 1, the packing rollers 8 and 10 are moved apart from each other.

The packing roller 9 is moved toward or apart from the packing rollers 8 and 10 through a cam mechanism or link mechanism (not shown) which is adapted to move the roller support arm 12 (or 15) in association with the roller support arm 15 (or 12).

At a position spaced away from the packing rollers 8, 9 and 10, a roll of packing paper 18 is rotatably supported about a shaft 19. The rolled packing paper 18 is unwound by feed rollers 20 and 21 which are located between the shaft 19 and the packing roller 10. The leading edge of the unwound packing paper 18 is then delivered in between the packing rollers 8, 9 and 10 and the coin stack. A cutter 22 is provided between the packing roller 10 and the feed rollers 20 and 21 and functions to cut the packing paper placed in tension between the packing roller 10 and the feed rollers 20 and 21.

The positional relationship between the feed rollers 20 and 21, the cutter 22 and the packing rollers 8, 9 and 10 is theoretically such that the packing paper 18 may be cut by the cutter 22 only when the packing paper 18 is placed in tension between the packing roller 8, 9 and 10 and the feed rollers 20 and 21. Therefore, the spacings between these components may be reduced if this reduction is within the range satisfying the above theoretical condition.

Drive system for driving said rollers and others will now be described below.

A pulley 22 is rigidly mounted on the top of the shaft 20*a* of the feed roller 20 and drivingly connected with a feed motor (not shown) through an endless belt 23, the feed motor consisting of a low-speed motor. The bottom of the pulley 22 includes a rotary disc 24 rigidly mounted thereon and having a plurality of slits formed thereon. These slits on the rotary disc 24 are read a sensor 25 to sense the amount of rotation in the feed roller 20. Signals from the sensor 25 are integrated and inputted into a control circuit (not shown) together with a value of the circumference of the feed roller 20. These values can be calculated by the control circuit to find the amount of delivery in the packing paper 18.

A spur gear 27 is mounted on the bottom of the shaft 20*a* through a one-way clutch 26. When the shaft 20*a* is rotated in the direction as shown by arrow (c) in FIG. 1, the spur gear 27 is rotated with the shaft 20*a* with its rotation being transmitted to an intermediate gear 28. The rotation of the intermediate gear 28 is then transmitted to a spur gear 30 through another intermediate gear 29 which is rotated with the first intermediate gear 28.

The spur gar 30 is rotatably supported by the shaft 14 functioning as a pivot for the roller support arm 15. The rotation of the spur gear 30 is transmitted to a spur gear 32 through a thrid intermediate gear 31. The spur gear 32 is rigidly mounted on the shaft 10*a* of the packing roller 10 to drive the latter.

The spur gear 30 meshes with a fourth intermediate gear 33 which in turn is drivingly engaged by a spur gear 34. The spur gear 34 is rotatably supported about the pivot shaft 11 of the roller support arm 12. The spur gear 34 is drivingly connected with a spur gear 36 through a fifth intermediate gear 35, the spur gear 36 being rigidly mounted on the shaft 8*a* of the packing roller 8. The spur gear 34 also is drivingly connected with a spur gear 38 through a sixth intermediate gear 37, the spur gear 38 being rigidly mounted on the shaft 9*a* of the packing roller 9.

The fourth intermediate gear 33 meshes with a drive gear 39 which is rigidly connected with a pulley 40. The pulley 40 is drivingly connected with a packing motor (high-speed motor) 42 through an endless belt 41.

The number of teeth in the respective gears are selected such that the peripheral speed of the packing rollers 8, 9 and 10 will be equal to that of the feed rollers 20 and 21.

Figure 3:
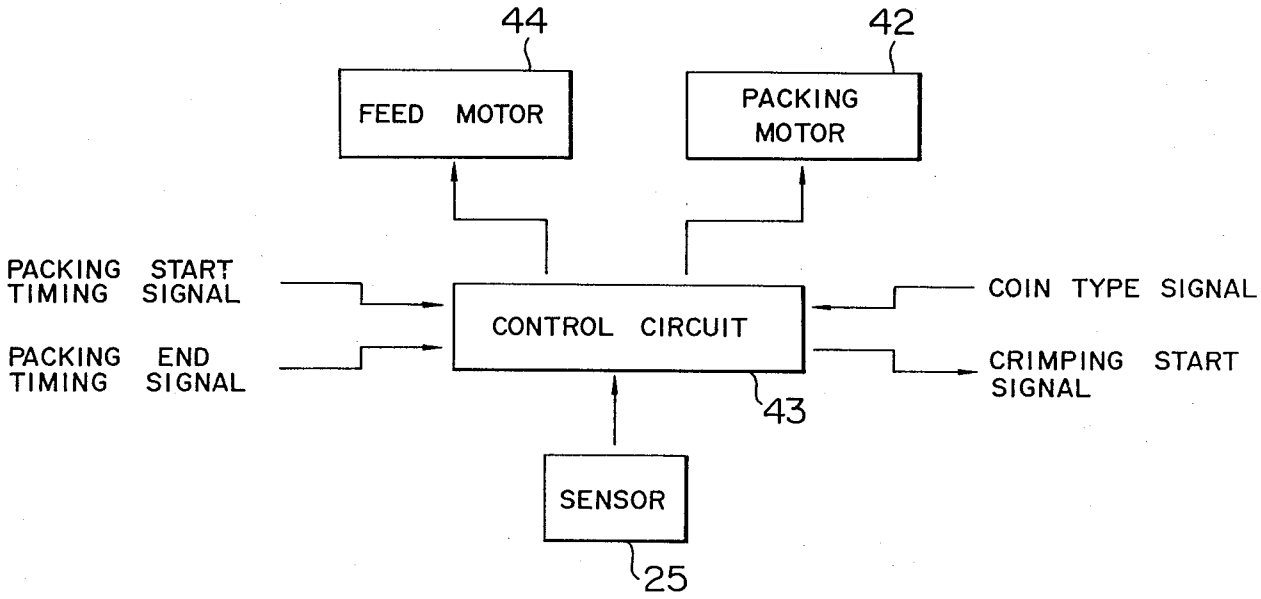
Figure 4:
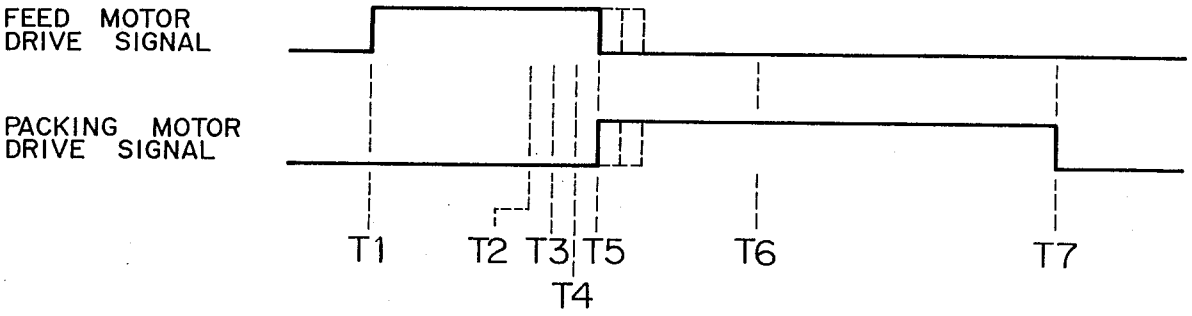

FIG. 3 is a block diagram showing a control system for controlling the delivering and winding of the packing paper 18.

The control system comprises a control circuit 43 which is adapted on the one hand to receive a coin type signal, a packing start timing signal, the output signal from the sensor 25 and a packing end timing signal and on the other hand to give a drive signal to the feed and packing motors 44, 42 and a crimping start signal to the other control sections (not shown).

When the control circuit 43 receives a packing start timing signal (for example, an output signal from a coin counting sensor in the coin passageway when the sensor detects that a predetermined number of coins has passed through the coin passageway), the control circuit 43 continuously gives drive signals to the feed motor 44 in response to a coin type signal and the output signal from the sensor 25 until the length of the packing paper 18 suitable for the type of coins to be wound is unwound from its roll by the driven feed rollers 20 and 21.

When a part of the unwound length of the packing paper 18 is subsequently wound around the coin stack, said control circuit 43 terminates the output of the drive signals to the feed motor 44 and at the same time gives drive signals to the packing motor 42. On the other hand, the control circuit 43 also gives a crimping start signal to a crimping mechanism (not shown) which is adapted to crimp the upper and lower ends of the packing paper 18 wound about the coin stack.

Figure 1:
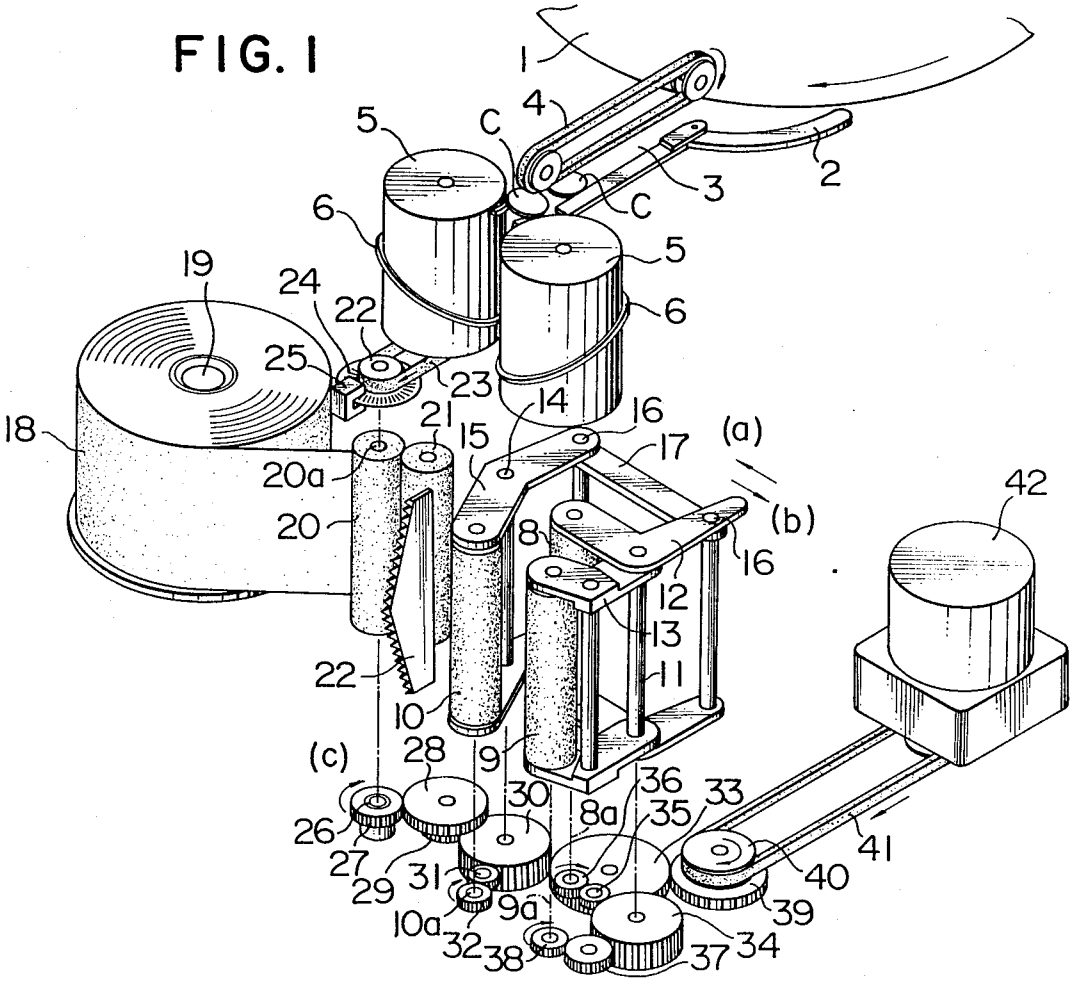
FIGS. 1 through 4 show a first embodiment of a paper delivering and winding apparatus to which the present invention is applied, FIG. 1 being a perspective view, FIG. 2 being a plan view of the coin stacking section, FIG. 3 being a block diagram of the control system and FIG. 4 being a timing chart showing the operation of the control circuit.

When the control circuit 43 receives a packing end timing signal (for example, an output signal from the crimping mechanism when after termination of the crimping to form a package of the coins, the proximal end portion of the roller support arm 12 is moved in the direction shown by arrow (b) in FIG. 1 to release the coin package from between the packing rollers 8, 9 and 10), the control circuit 43 terminates the output of the drive signals to the packing motor 42.

Said crimping mechanism, a mechanism for moving the supporrt member to receive and transfer the stacked coins between the packing rollers 8, 9 and 10 and a roller actuating mechanism for closing or opening the packing rollers 8, 9 and 10 at a given time to hold or release the stacked coins, may be any suitable mechanisms, for example, as disclosed in Japanese Laid-Open Patent Application 54-31382. Such mechanisms may be actuated by a single cam motor and a cam mechanism.

The packing operation described above will be described in more detail in accordance with the timing chart of FIG. 3. In the following description, "Tn" denotes the n-th timing in the timing chart.

Preparatory operation: When the rotary disc 1 is rotated with coins placed thereon, the coins C are delivered into the coin passageway 3 one by one. The delivered coins C are then guided and stacked by the rotating stacking drums 5. When a predetermined number of the coins has been stacked, a packing start timing signal is generated. The stacked coins are held in the stacking area defined between the stacking drums 5 and the guide member 7.

T1: As the control circuit 43 receives the packing start timing signal, a feed motor drive signal is produced to energize the feed motor 44. The feed roller 20 then begins to be rotated by the feed motor 44 such that the packing paper 18 is unwound from its roll by the cooperation of the feed rollers 20 and 21 at a low speed. It is desirable that the speed of the unwound packing paper 18 be selected such that the leading edge thereof will not be turned up by life created by the movement of the packing paper 18. The rotation of the feed roller 20 is determined by the sensor 25 sensing the slits on the rotary disc 24. Detection signals from the sensor 25 are supplied to the control circuit 43 wherein the length of the delivered packing paper 18 is determined in accordance with the above detection signals. At the same time, the shutter (not shown), which supports the stacked coins below the stacking drums 5, is opened to transfer the coin stack onto the support member (not shown). This support member is then moved downwardly to position the stacked coins between the packing rollers 8, 9 and 10. The rotation of the feed motor (not shown) is further transmitted to the intermediate gear 28 through the one-way clutch 26 and also to the respective packing rollers 8, 9 and 10 through the corresponding intermediate and spur gears. As a result, the packing rollers 8, 9 and 10 will be rotated in association with each other at a low speed.

T2: The movement of the stacked coins between the packing rollers 8, 9 and 10 by the support member is terminated.

T3: The leading edge of the packing paper 18 being moved at the low speed is moved in between the stacked coins C and the packing roller 9.

T4: The packing rollers 8, 9 and 10 are closed to hold the packing paper 18 between these packing rollers and the coin stack. At this time, the speed of the moved packing paper is equal to the peripheral speed of the packing rollers 8, 9 and 10. Therefore, no shock is exerted on the packing paper 18 when the latter is initially held between the packing roller 9 and the stacked coins C.

T5: When in response to the signal from the sensor 25, the control circuit 43 judges that the length of the packing paper 18 suitable for the type of coins to be packed (for example, a length corresponding to two windings) has been delivered from the roll, the control circuit 43 terminates the rotation of the feed motor 44 and at the same time sends drive signals to the packing motor 42. The rotation of the packing motor 42 is transmitted to the packing rollers 8, 9 and 10 through the drive gear 39 via the respective intermediate and spur gears. As a result, the packing rollers 8, 9 and 10 are rotated at a speed higher than that in the timing T1 through T4. The packing paper 18 is then wound about the stacked coins C. When the feed motor is stopped, the feed motor 44 or either of the feed rollers 20 or 21 is braked to forcedly restrain the unwinding of the packing paper 18. When the unwinding of the packing paper 18 is restrained the tension therein is gradually increased, urging the packing paper 18 against the cutter 22 so that the packing paper is severed by the cutter 22. While the packing paper 18 is being delivered, it is wound around part of the outer periphery of the stacked coins C. In such a manner, the control circuit 43 will sense said predetermined length of the delivered packing paper 18 so as to determined that a part of the packing paper 18 has been wound about the stacked coins.

T6: After passage of a predetermined time from the start of the packing operation (a period of time sufficient to wind a predetermined length of the packing paper 18, for example, through two windings about the stacked coins), the process proceeds to a crimping timing whereat crimping pawl means is pressed against the upper and lower ends of the packing paper 18 wound about the stacked coins C while rotating the stacked coins. Thus, the upper and lower ends of the wound packing paper 18 are crimped to form a package of the stacked coins.

T7: After passage of a predetermined time from the crimping timing, the process proceeds to a packing end timing whereat the coin package (stacked coins) is released from the three packing rollers and at the same time the packing motor 42 is stopped.

More particularly, the packing motor 42 is stopped and at the same time the support arms 12, 13 and 15 are swung to separate the packing rollers 8, 9 and 10 from the coin package, so that the coin package will fall into a package receiving station. The packing process is thus terminated and the next packing process can immediately be initiated.

It is noted that although the gears 27 to 39 are rotated by the rotation of the packing motor 42, the rotation of the gear 27 in the direction shown by arrow (c) will not be transmitted to the shaft 20*a* of the packing roller 20 since the one-way clutch 26 is interposed between the gear 27 and the shaft 20*a*. Therefore, the packing rollers 20 and 21 are braked while holding the leading edge of the rolled packing paper therebetween.

Figure 6:
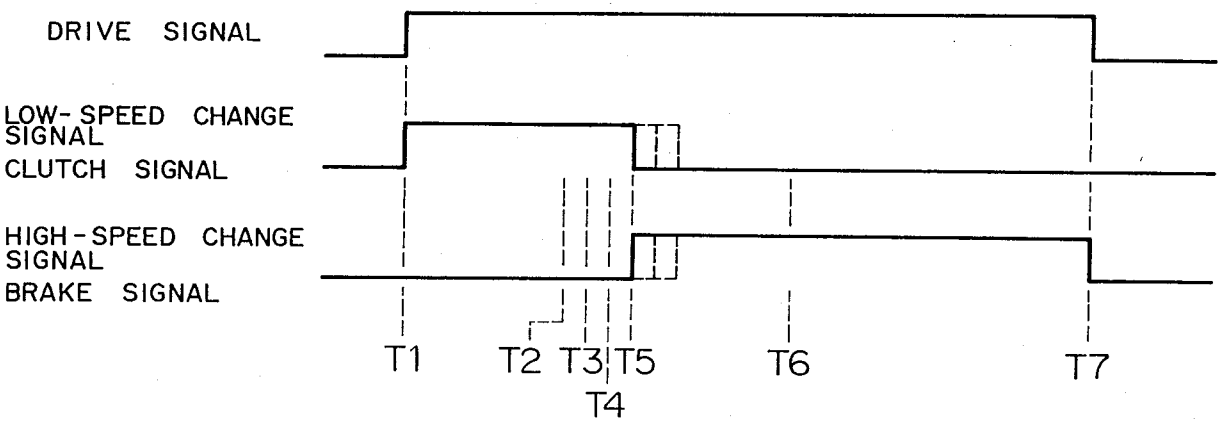
FIGS. 5 and 6 show a second embodiment of a paper delivering and winding apparatus to which the present invention is applied, FIG. 5 being schematic view of the drive system and FIG. 6 being a timing chart illustrating the operation of the control circuit.
Figure 5:
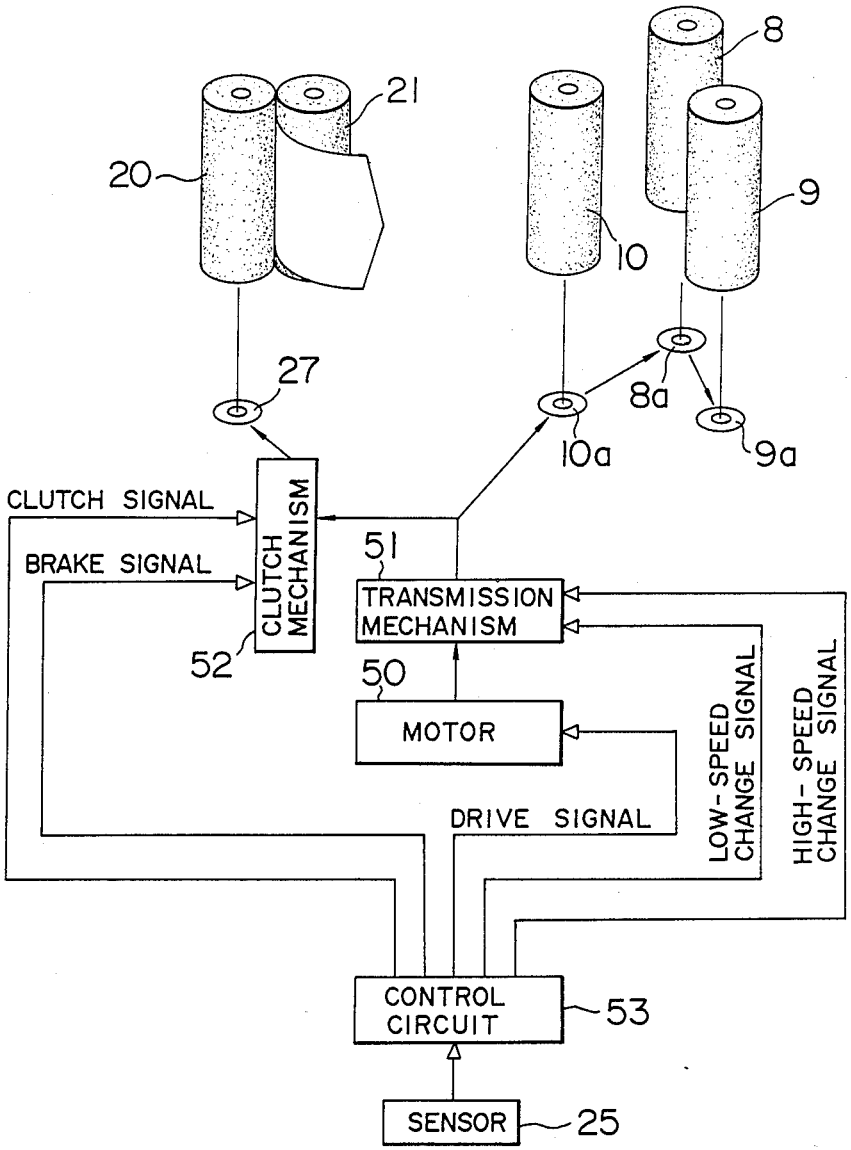

FIGS. 5 and 6 shows a second embodiment of the present invention.

In the second embodiment, the drive system for the feed and packing rollers 20, 8, 9 and 10 in the coin packing machine shown in the first embodiment is modified. The modified drive system comprises a packing motor 50 rotatable at a fixed speed, a transmission mechanism 51 for converting the rotation of the packing motor 50 to a high-speed or low-speed rotation and also for transmitting the rotation of the packing motor 50 to the packing rollers 8, 9 and 10 and to the feed roller 20, and a clutch mechanism 52 interposed between the transmission mechanism 51 and the feed roller 20 and adapted to connect and disconnect the feed roller 20 with the transmission mechanism 51.

The packing motor 50, the transmission mechanism 51 and the clutch mechanism 52 are electrically connected with a control circuit 53 which is responsive to feed roller rotation detection signals from the sensor 25 to generate drive signal, high-speed change signal, low-speed change signal, brake signal and clutch signal.

The function of this control circuit 53 will now be described with reference to FIG. 5 in connection with the coin packing operation.

Prior to the coin packing operation, a preparatory operation is carried out as in the first embodiment. When a predetermined number of coins is stacked in the aforementioned manner, the process proceeeds to the packing start timing.

T1: At the packing start timing, the control circuit 53 generates drive signals which in turn are supplied to the packing motor 50 to initiate its rotation at a fixed speed. At the same time, a low-speed change signal is given from the control circuit 53 to the transmission mechanism 51 which in turn initiates rotation of the packing rollers 8, 9 and 10 at a low speed. The control circuit 53 further generates a clutch signal which in turn is supplied to the clutch mechanism 52 to connect the transmission mechanism 51 with the feed roller 20. Thus, the feed roller 20 will be rotated at a low speed. Simultaneously, the shutter (not shown), which supports the stacked coins C below the stacking drums 5, is moved to its opened position so that the stacked coins C fall between the packing rollers 8, 9 and 10. The rotation of the feed roller 20 is sensed by the sensor 25 which in turn generates a detection signal supplied to the control circuit 53 to initiate the measurement of the amount of the delivered packing paper 18.

T2: The stacked coins C are fed to a predetermined position.

T3: The leading edge of the packing paper 18 delivered at the low speed is moved in between the stacked coins C and the packing roller 9.

T4: The packing paper 18 is further delivered to gradually wind about the outer periphery of the stacked coins C.

T5: When the control circuit 53 is responsive to the signal from the sensor 25 to determine that a predetermined length of the packing paper 18 suitable for the type of the coins to be packed (for example, a length corresponding to two windings) has been delivered, the control circuit 53 generates a brake signal which in turn is supplied to the clutch 52. The clutch 52 is then actuated to disconnect the transmission mechanism 51 from the feed roller 20. At the same time, the rotation of the feed roller 20 is limited to suppress the delivery of the packing paper 18. The control circuit 53 also generates a high-speed signal which is supplied to the transmission mechanism 51. Thus, the transmission mechanism 51 converts its output into a high speed rotation so that the packing rollers will be rotated at a high speed. Before the delivery of the packing paper 18 is stopped, it is wound about a part of the outer periphery of the stacked coins C. When the delivery of the packing paper 18 is stopped and then the packing rollers 8, 9 and 10 are rotated at the high speed, the tension in the packing paper 18 is increased to urge it against the cutter 22. Thus, the packing paper 18 will be severed by the cutter 22.

T6: After passage of a predetermined time fromt he packing start timing (a period of time required to wind the packing paper 18 about the stacked coins C through a predetermined length, for example, corresponding to two windings), the process proceeds to a crimping timing whereat crimping pawl means is actuated to crimp the upper and lower ends of the packing paper 18 wound about the stacked coins.

T7: After passage of a predetermined time from the crimping timing, the process proceeds to the packing end timing whereat the coin package is released from between the three packing rollers. Simultaneously, the control circuit 53 terminates the output of drive signals to the motor 50.

(a) The drive mechanism for the feed and packing rollers is not limited to those of the first and second embodiments described above. For example, the combination of the constant speed motor with the transmission mechanism in the second embodiment may be replaced simply by a variable speed motor such as a DC motor, pole change motor, inverter control motor or the like. In such a case, the high- and low-speed change signals inputted to the transmission mechanism may be utilized as speed change signals for said variable speed motor. Thus, the speed control can be carried out as in the second embodiment.

(b) The coin stacking mechanism is not limited to the stacking drum system shown in the first embodiment and may be any suitable stacking system used in the prior art coin packing machines.

(c) In the previously described embodiments, the rotation of the packing rollers is converted from the low speed to the high speed when the predetermined length of the packing paper has been delivered, because the length of the packing paper to be delivered is too long in comparison with the distance between the feed roller and the packing rollers. If some time lag is provided between the detection timing of the sensor for sensing the length of the packing paper and the initiation of the high-speed rotation of the packing rollers, the length of the packing paper to be wound about the stacked coins may already be excessive.

(d) It is desirable that the rotational speed of the respective rollers be lower from the viewpoint of stabilizing the delivery of the packing paper. It is also desirable that the rotational speed of the rollers be higher from the viewpoint of promoting the packing process.

As will be apparent from the foregoing, the present invention provides a coin packing apparatus comprising a drive mechanism for rotating the packing and feed rollers and a control circuit for detecting that a predetermined length of the packing paper to be wound about the stacked coins has been delivered by feed rollers, said drive mechanism being responsive to the absence of a detection signal from the control circuit to the feed and packing rollers together at the low speed and responsive to a detection signal from the control circuit to stop the feed roller and to rotate the packing rollers at the high speed. Therefore, the coin packing apparatus according to the present invention has the following advantages:

(a) When the packing paper is held between the packing roller and the stacked coins, the peripheral speed of that packing roller is equal to the speed of movement in the packing paper. Therefore, a shock created when the packing paper is held between the packing roller and the stacked coins can be reduced without failure, such as for example, the packing paper winding spirally about the stacked coins.

(b) Since the packing rollers are rotated at the high speed after the packing paper has been wound about the stacked coins, the speed of the packing process can be increased.

What we claim is:

1. An apparatus for delivering and winding packing paper in a coin stacker, said apparatus comprising:

packing roller means for receiving stacked coins and for holding the stacked coins to cause a rotative movement of the stacked coins and for winding a sheet of packing paper about the stacked coins while providing the packing paper with a certain tensional force, feed roller means for delivering the packing paper between the stacked coins and said packing roller means, low speed drive means connected with said feed roller means and said packing roller means for driving said feed roller means and said packing roller means at a constant, relatively low speed, high speed drive means connected with said packing roller means for driving only said packing roller means at a relatively high speed, sensing means for sensing a length of the packing sheet fed through said feed roller means for winding around the stacked coins, and control means for receiving a signal form said sensing means and actuating said low speed drive means for initial feeding of a predetermined length of packing paper around the stacked coins and actuating said high speed drive means when said sensing means detects said predetermined length of packing paper has been fed through said feed roller means and wrapped around the stacked coins.

2. An apparatus in accordance with claim 1, wherein said predetermined length of the packing paper is such a length that a leading portion of the packing paper fed through said feed roller means is wound around the stacked coins.

3. An apparatus for delivering and winding packing paper in a coin stacker, said apparatus comprising:

packing roller means for receiving stacked coins and holding the stacked coins to cause a rotative movement of the stacked coins and for winding a sheet of packing paper about the stacked coins while providing the packing paper with a certain tensional force, feed roller means for delivering the packing paper between the stacked coins and said packing roller means, drive means for driving said packing roller means and said feed roller means, transmission means connected to said drive means for transmitting a driving force from said drive means to said packing roller means at one of a relatively low speed and a relatively high speed, switching means for switching a transmission of the driving force of said drive means between the relatively low speed and the relatively high speed, clutch means provided between said transmission means and said feed roller means for allowing the driving force of said drive means to be transmitted to said feed roller means when said switching means causes said transmission means to provide the relatively low speed, braking means for preventing a driving force of said drive means from being transmitted to said feed roller means through said clutch means when said switching means causes said transmission means to provide said packing roller means with the relatively high speed, sensing means for sensing a length of the packing sheet fed for winding the stacked coins through said feed roller means, and control means for receiving a signal from said sensing means and actuating said switching means to cause said transmission means to provide said packing roller means with the relatively high speed when said sensing means detect a predetermined length of said packing paper fed through said feed roller means.

4. An apparatus for delivering and winding packing paper in a coin stacker, said apparatus comprising:

packing roller means for receiving stacked coins and for holding the stacked coins to cause a rotative movement of the stacked coins and for winding a sheet of rolled packing paper about the stacked coins while providing the packing paper with a certain tensional force, feed roller means for delivering the packing paper between the stacked coins and said packing roller means, variable drive means rotatable at least two different speeds for producing a driving force for rotating said packing roller means at least two different speeds, transmission means provided between said variable drive means and said packing roller means and said feed roller means for transmitting the driving force of said variable drive means to said packing roller means and said roller means, switching means for switching the speed of said variable drive means, clutch means provided between said transmission means and said feed roller means for allowing the driving force of said variable drive means to be transmitted to said feed roller means when said variable drive means is rotated at a relatively low speed, braking means for preventing the driving force of said variable drive means from being transmitted to said feed roller means through said clutch means when said variable drive means is rotated at a relatively high speed, sensing means for sensing a length of the packing sheet fed for winding the stacked coins through said feed roller means, and control means for receiving a signal from said sensing means and actuating said switching means to cause said variable drive means to be rotated at the relatively high speed when said sensing means detect a predetermined length of the packing paper fed through said feed roller means.

* * * * *